US005894039A

United States Patent [19]

Tsai et al.

[11] Patent Number: 5,894,039

[45] Date of Patent: Apr. 13, 1999

[54] MANUFACTURING METHOD OF WATER-COVER TYPE TRANSPARENT KEYBOARD

[75] Inventors: Chi-Lung Tsai, Taipei Hsien; Chui-Yu Chiu, Taipei, both of Taiwan

[73] Assignee: Silitek Corporation, Taipei, Taiwan

[21] Appl. No.: 09/102,824

[22] Filed: Jun. 23, 1998

[51] Int. Cl.[6] ..... B05D 3/00

[52] U.S. Cl. ..... 427/555; 427/258; 427/353; 427/370; 427/385.5; 427/407.1; 427/421; 427/430.1; 427/596

[58] Field of Search ..... 427/407.1, 430.1, 427/385.5, 353, 370, 421, 258, 555, 596

*Primary Examiner*—Bernard Pianalto

*Attorney, Agent, or Firm*—Rosenberg, Klein & Bilker

[57] ABSTRACT

A manufacturing method of water-covering type transparent keyboard comprises the steps of preparing the main body of silicone rubber keyboard, surface printing and coating, polyurethane layer coating, polyvinylalcohol thin film dipping, water rinsing, laser engraving text and graph forming, and polyurethane protective layer coating to form a water-covering keyboard. The water-covering type transparent keyboard according to the present invention can realize the effect of softness and good coherence.

17 Claims, 1 Drawing Sheet

MANUFACTURING METHOD OF WATER-COVER TYPE TRANSPARENT KEYBOARD

FIELD OF THE PRESENT INVENTION

The present invention relates to a manufacturing method of water-covering type transparent keyboard, more particularly, to a manufacturing method of transparent keyboard which can be used for electronic communication product and remote controller.

BACKGROUND OF THE INVENTION

The conventional transparent keyboards used in the applications such as mobile phone, pager, telephone, remote control, or audio set are generally made of silicone rubber. However, this kind of keyboard made transparent silicone rubber material is not satisfactory in aesthetic aspect.

Moreover, another kind of keyboard is made of transparent rubber with metal film and has a more appealing appearance. This keyboard is made of plastic material with metal film coating thereon, and then combined with silicone rubber. However, this kind of keyboard has complicated manufacturing process and the problem of reliability due to the delamination occurring between the rubber and silicone rubber.

Therefore, the present invention is intended to provide a method of manufacturing keyboard by which the quality and aesthetics of keyboard can be enhanced with reduced cost.

The object of the present invention is to provide a manufacturing method of water-covering transparent keyboard wherein a polyvinyl alcohol (PVA) film is covered onto a conventional silicone rubber keyboard to realize the effect of softness and good coherence.

The another object of the present invention is to provide a manufacturing method of water-covering transparent keyboard by which the laser/engraving (L/E) silicone rubber keyboard has a diverse and attractive color and has enhanced value. Moreover, it can meet the requirement of environment protection because the single-colored rubber-type ink is not used.

The manufacturing method of the water-covering transparent keyboard comprises the steps of preparing the main body of silicone rubber keyboard, surface printing and coating, polyurethane layer coating, PVA thin film dipping, water rinsing, L/E text and graph forming, and PU protective layer coating to form a water-covering keyboard.

The various objects and advantages of the present invention will be more readily understood from the following detailed description when read in conjunction with the appended drawings, in which:

Figure 1:
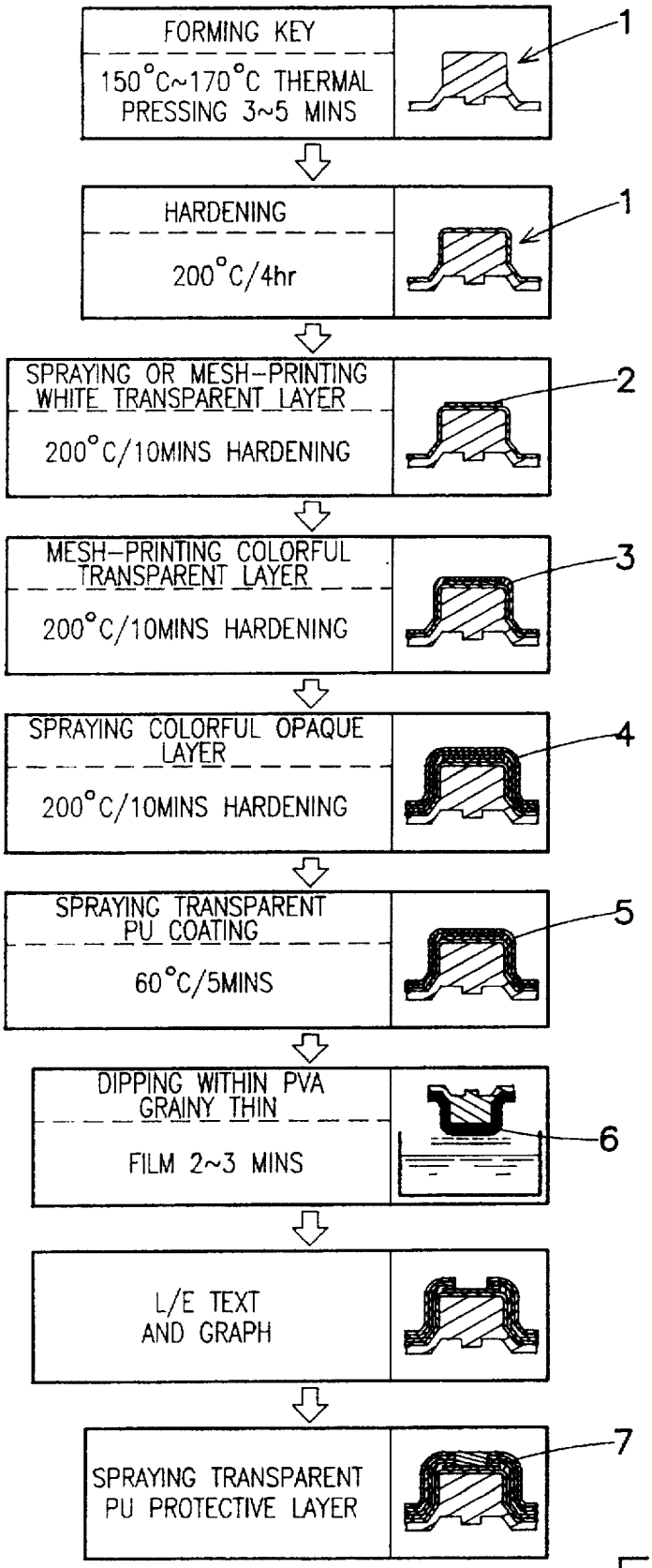
FIG. 1 shows the flowchart of manufacturing process of the keyboard according to the present invention.

NUMERAL 1. silicone rubber
2. first transparent layer
3. second transparent layer
4. first opaque layer
5. PU layer
6. grainy layer
7. protective layer

DETAILED DESCRIPTION OF THE PREFERRED EMBODIMENT

FIG. 1 shows the manufacturing flowchart of the present invention. The present invention provides a water-covering transparent keyboard, which is adapted from an already-formed silicone rubber keyboard 1. The keyboard 1 is made of transparent silicone rubber.

The silicone rubber keyboard 1 is subjected to a hardening process of 200° C., 4 hr. The keyboard 1 is subjected to a 150° C.~170° C., 3~5 mins thermal pressing process. Afterward, a first transparent layer 2 of rubber-type ink is formed on the silicone rubber keyboard 1. The first transparent layer 2 is a white transparent layer formed by a spraying or mesh-printing process. Then, a 200° C. and 10 mins hardening process is carried out.

Afterward, a second transparent layer 3 of rubber-type ink is formed on the first transparent layer 2. The second transparent layer 3 is a colorful transparent layer formed by mesh-printing process and subjected to a 200° C. and 10 mins hardening process.

A first opaque layer 4 of rubber-type ink is formed on the second transparent layer 3. The first layer 4 is a colorful opaque layer (brown color) formed by spraying ad then subjected to a 200° C. and 10 mins hardening treatment.

Afterward, a PU layer 5 is formed on the first opaque layer 4 by spraying transparent PU coating. The coating time is about 5 mins and the coating temperature is 60° C. to get a semi-finished product of the present invention.

The above semi-finished product is dipped into PVA grainy film for 2–3 mins and then rinsed by water to form PVA grainy pattern 6 on the PU layer 5.

Then the resulting product is marked with text and graph 5 by laser treatment and then coated with transparent PU coating and polyamine-ethylformate as protective layer 7, thus finishing the transparent keyboard according to the present invention.

The water-covering transparent keyboard is to process the already-formed silicon rubber keyboard, with PU treatment, and then to coat the resulting product with PVA grainy film. Therefore, the binding force between PVA film and silicone rubber is enhanced.

The water-covering transparent keyboard according to the present invention replace the conventional single-colored rubber ink with PVA grainy film. Therefore, the L/E transparent keyboard is more attractive, colorful and environment-concerned.

To sum up, by the method provided by the present invention, transparent keyboard with excellent invention and aesthetics can be manufactured. Moreover, PVA film and silicone rubber have good adherence there between.

Although the present invention has been described with reference to the two preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A manufacturing method of water-covering type transparent keyboard comprising the steps of:

(1) preparing a silicone rubber keyboard made of transparent silicone rubber;

(2) performing a hardening treatment on said silicone rubber keyboard;

(3) forming a first transparent layer on said silicone rubber keyboard, and performing a hardening treatment on resulting structure;

(4) forming a second transparent layer on said first transparent layer, and performing a hardening treatment on resulting structure;

(5) forming a first opaque layer on said second transparent layer, and performing a hardening treatment on resulting structure;

(6) forming a polyurethane layer on said first opaque layer;

(7) dipping the resulting structure within a polyvinyl alcohol thin film and performing water-rinsing treatment; and (8) performing a laser engraving process on said silicone rubber keyboard.

2. The manufacturing method as in claim 1, wherein said hardening treatment in step (2) has temperature of 200° C. and duration of 4 hr.

3. The manufacturing method as in claim 1, wherein a 150° C.~170° C., 3~5 mins thermal pressing process is performed after said step (2).

4. The manufacturing method as in claim 1, wherein said first transparent layer in said step (3) is formed by spraying.

5. The manufacturing method as in claim 1, wherein said first transparent layer in said step (3) is formed by mesh-printing.

6. The manufacturing method as in claim 1, wherein said first transparent layer in said step (3) is a white transparent layer.

7. The manufacturing method as in claim 1, wherein said hardening treatment in step (3) has temperature of 200° C. and duration of 10 min.

8. The manufacturing method as in claim 1, wherein said second transparent layer in said step (4) is formed by mesh-printing.

9. The manufacturing method as in claim 1, wherein said second transparent layer in said step (4) is a colorful transparent layer.

10. The manufacturing method as in claim 1, wherein said hardening treatment in step (4) has temperature of 200° C. and duration of 10 min.

11. The manufacturing method as in claim 1, wherein said first opaque layer in said step (5) is formed by spraying.

12. The manufacturing method as in claim 1, wherein said first opaque layer in said step (5) is a colorful opaque layer.

13. The manufacturing method as in claim 1, wherein said hardening treatment in step (5) has temperature of 200° C. and duration of 10 min.

14. The manufacturing method as in claim 1, wherein said polyurethane layer in step (6) is formed by spraying a polyurethane coating.

15. The manufacturing method as in claim 1, wherein said step (6) has spraying time 5 min and spraying temperature 60° C.

16. The manufacturing method as in claim 1, wherein the dipping time in said step (7) is about 2–3 min.

17. The manufacturing method as in claim 1, wherein a transparent PU protective layer is further formed after said step (8).

* * * * *